US005832613A

United States Patent [19]

Rhodes

[11] Patent Number: 5,832,613

[45] Date of Patent: Nov. 10, 1998

[54] CUTTING APPARATUS

[75] Inventor: Michael Kenneth Adrian Rhodes, Drummoyne, Australia

[73] Assignee: Port Bell Pty Ltd, Queensland, Australia

[21] Appl. No.: 464,887

[22] PCT Filed: Dec. 10, 1993

[86] PCT No.: PCT/AU93/00637

§ 371 Date: Jan. 22, 1996

§ 102(e) Date: Jan. 22, 1996

[87] PCT Pub. No.: WO92/13439

PCT Pub. Date: Jun. 23, 1994

[30] Foreign Application Priority Data

Dec. 10, 1992 [AU] Australia ..... PL6289

[51] Int. Cl.[6] ..... B67B 7/49

[52] U.S. Cl. ..... 30/294; 30/DIG. 3

[58] Field of Search ..... 30/21, DIG. 3, 30/294, 289

[56] References Cited

U.S. PATENT DOCUMENTS 4,360,970 11/1982 Ostroski et al. ..... 30/DIG. 3

5,103,562 4/1992 Braatz ..... 30/2

5,117,524 6/1992 Chang ..... 30/DIG. 3

*Primary Examiner*—Douglas D. Watts

*Attorney, Agent, or Firm*—Amster, Rothstein & Ebenstein

[57] ABSTRACT

A cutting apparatus (10) comprising a cutting assembly (11) mounted on a mounting member/actuation member (12) which is pivotally connected to an article support member (13) having a receiving portion (14). In use a user may, by tightening his or her grip about the apparatus (10) overcome the resistance provided by the leaf spring (25) and thereby urge the free ends of the mounting member (12) and the article support member (13) together such that the incising end portion (16) of the blade assembly (11) extends through the slit (30) and engages the complementary shaped recess (14) so as to form an incision in the article (50). The user may, while maintaining sufficient pressure on the mounting member/actuating member (12), draw or slide the apparatus (10) relative to the material in a general direction indicated by arrow (51), for example, such that the cutting edge (18) cuts the portion of the material (50) which it bears against.

2 Claims, 2 Drawing Sheets

CUTTING APPARATUS

This invention relates to cutting apparatus.

This invention has particular but not exclusive application to cutting apparatus for use in opening sealed containers such as envelopes, and for illustrative purposes reference will be made to such application. However, it is to be understood that this invention could be used in other applications such as for making incisions in a material or for shredding a material.

For safety reasons, it is undesirable to provide disabled persons, epileptics or children in particular, or persons traveling in a vehicle in general, with cutting instruments having a cutting edge which during normal conditions of use are accessible to parts of the human body such as fingers or the like and which as a result of misuse may injure the user such as when attempting to open sealed envelopes or the like.

It is also noted that many couriers use envelopes or bags made from a plastics material and wherein the bags are difficult to open once the closure flap has been sealed even with the aid of a pair of scissors. However, it is noted that scissors tend to be rather bulky and typically include sharp points and exposed cutting edges which may injure persons or damage property if carried for example in a persons pocket, handbag or brief case.

The present invention aims to alleviate one or more of the above disadvantages and to provide cutting apparatus which will be reliable and efficient in use.

With the foregoing in view, this invention in one aspect resides broadly in

In one embodiment the cutting assembly may comprise a fine wire which may be smooth or serrated.

In an alternative embodiment the cutting assembly may include a cutting blade which may comprise one or more cutting edges which may be sharpened or which may include a plurality of teeth. For example, the cutting blade may include a single cutting edge which forms part of or is integral with the incising end portion and wherein the cutting blade may include an arcuate cutting edge or a substantially straight cutting edge which may extend upwardly from a lower end portion of the cutting blade whereby in use a lower portion of the cutting edge may be employed to form an incision in the material to be cut.

Alternatively the blade assembly may include a cutting blade having a lower incising end portion which is distinctive from a cutting edge extending upwardly therefrom. For example, the incising portion may include a pointed end portion, which may be sharp or blunt, and wherein the cutting edge may comprise a sharpened side edge of the cutting blade. However it will be appreciated that the incising end portion may be straight or curved.

In a preferred embodiment however, the cutting assembly includes a cutting blade comprising a pair of opposing side cutting edges separated at their distal end by a pointed incising end portion having outwardly divergent cutting edges.

In addition, the cutting assembly may be removable and wherein the cutting assembly may also include locking means for restricting access to and/or the removal of the cutting assembly. For example worn or broken cutting blades may be replaced by new or freshly sharpened blades, access to which may be controlled by appropriate locking means.

In one embodiment the mounting means and the article support means may be constituted by respective upper and lower portions of the apparatus and wherein the position of the upper portion relative to the lower portion may be fixed or may be selectively varied. For example, the apparatus may include mounting means and article support means maintained in a fixed, spaced, relationship by connecting means.

Alternatively, the mounting means and the article support means may be maintained in a spaced relationship by connecting means which may be actuated so as to urge together or otherwise reduce the spacing separating the mounting means and the article support means.

In yet another embodiment, a portion of the mounting means may be pivotally connected to a portion of the article support means such that the opposing portions of the mounting means on which the cutting assembly is mounted and the article support means may be urged together and wherein the mounting means may also constitute the actuation means For example, the cutting assembly may be mounted on a mounting member which is pivotally connected to an article supporting member and wherein the cutting assembly or cutting blade mounted on the mounting member remote from the pivotal connection may be urged toward the receiving portion of the article supporting member by movement of the mounting member in the general direction of the article supporting member.

The article support means or member may comprise a substantially planar surface which is generally orthogonal to a plane containing the cutting assembly and wherein the receiving portion may include a recess and wherein the recess and the incising end portion may be complementary. Furthermore, the complementary recess may be arranged to provide a shearing action against the cutting edges and/or incising end portion of the cutting assembly and whereby in use material to be cut may be placed between the article support means and the mounting means, and a cutting operation commenced by actuating the actuation means such that the incising end portion is extended towards the receiving portion so as to pierce the material. The cutting operation may be continued by either repeating the operation thus far described, or movement of the cutting assembly in a plane containing the cutting portion whilst maintaining the cutting assembly in its extended attitude.

In an alternative embodiment, the receiving portion may be substantially flat and/or the receiving portion may be constructed from a soft, resilient or moldable material.

The actuation means, in one embodiment, as referred to above may comprise the mounting means pivotally connected to the article support means. However, in an alternative embodiment, the actuation means may comprise suitable means for advancing the blade assembly such as a piston or plunger extending upwardly from the blade assembly and which may also be mounted on the mounting means.

The actuation means may also include biasing means such as a spring whereby in use the blade assembly may be maintained in an inoperative position unless actuated by the actuation means.

The cutting apparatus may also be provided with guide means adapted to at least partially conceal or prevent access to the cutting assembly such as for example the cutting edge and/or incising end portion of a cutting blade when retained in an inoperative position by, for example, biassing means. The guide means may alternatively, or in addition, provide support for the cutting assembly at a position adjacent the article support means whereby, for example, a relatively thin cutting blade may be utilised.

The guide means may be mounted on the mounting means or the article support means.

In the preferred embodiment, the mounting means, guide means and article support means are hingedly connected elongate members extending from a common hinged connection and wherein the cutting assembly comprises a cutting blade mounted on the mounting member such that the blade is contained in a plane which is substantially parallel to the axis of the aforementioned hinged connection. In addition, the guide means, mounting means and article support means are preferably spring biassed from a closed position wherein the distal ends of the guide member, mounting member and article support member are substantially abutting to an open position wherein the distal ends of the guide member, mounting member and article support member are spaced apart.

In use, the mounting member and article support member or at least the distal portions thereof are moved toward one another with the guide member interposed therebetween to cause the extension of the cutting blade from the guide member and into operative engagement with the receiving portion of the article support member.

In a further preferred form, the guide member is interposed between the article support member and the mounting member and includes abutment means interposed between the guide member and the article support member whereby the receiving portion is spaced from the guide member a desired distance so that a desired length of cutting blade is exposed as the cutting portion.

The cutting apparatus may further include a safety lock to prevent the article support member being opened away from the remainder of the cutting apparatus whereby the cutting portion may be exposed.

In order that this invention may be more readily understood and put into practical effect, reference will now be made to the accompanying drawings which illustrate a preferred embodiment of this invention and wherein.

Figure 1:
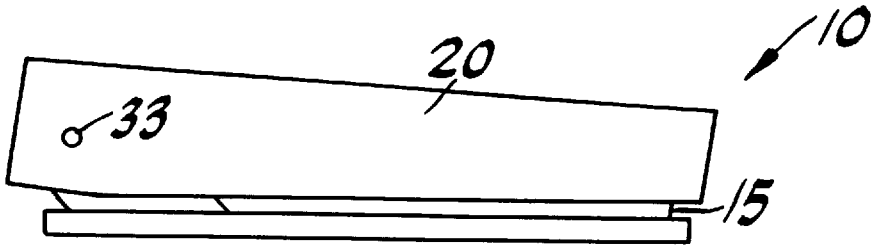
FIG. 1 is a side view of cutting apparatus constructed in accordance with the present invention with the cutting assembly shown in its extended or operative position.

FIGS. 1 to 6 illustrate a cutting apparatus 10 comprising a cutting assembly 11 mounted on mounting means/actuation means 12 which is pivotally connected to article support means 13 having a receiving portion 14.

Figure 7:
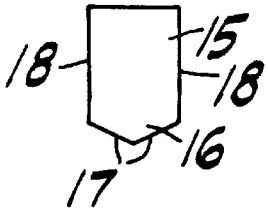
FIG. 7 is a front view of a cutting blade belonging to the cutting apparatus illustrated in FIG. 1.

The cutting assembly 11 includes a cutting blade 15 having an incising end portion 16, comprising two substantially straight cutting edges 17 diverging outwardly from a centrally located pointed end, and a pair of opposing, straight, cutting edges 18 extending upwardly therefrom as generally illustrated in FIG. 7. The base of the cutting blade 5 is mounted on the mounting means or mounting member 12 generally at 19.

Figure 2:
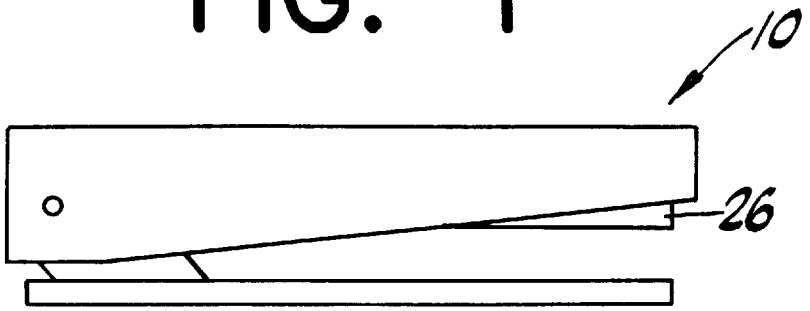
FIG. 2 is a side view of cutting apparatus illustrated in FIG. 1 but wherein the cutting assembly is shown in its retracted or inoperative position.

The mounting means or mounting member 12 is rather elongate and includes a housing comprising opposing side walls 20 separated by a top wall 21 and a front wall 22. The housing also includes a cylindrically shaped recess 23 formed in the top wall 22 and wherein the recess includes a centrally located bore 24 formed in the base wall thereof. The housing is used to house biasing means comprising a leaf spring 25, one end of which is attached to the underside of the top wall 21, and guide means comprising an elongate guide member 26 adapted to at least partially conceal the cutting assembly 11 in it's inoperative position, as illustrated in FIGS. 2 and 5, and to provide support for the cutting edges 18 when the cutting assembly is in it's operative position, as illustrated in FIGS. 1 and 6.

The guide member 26 comprises a pair of opposing side walls 27 separated by a front wall 28 and a base wall 29, which includes a transversely orientated slit 30 formed therein adjacent said front wall through which the cutting blade 15 may selectively extend.

The opposing or fixed end 31 or the guide member 26 is pivotally connected to the mounting member 12 and to opposing mounting brackets 32, of the article support means or member 13, by a pin 33 which extends through aligned apertures formed therein.

Figure 5:
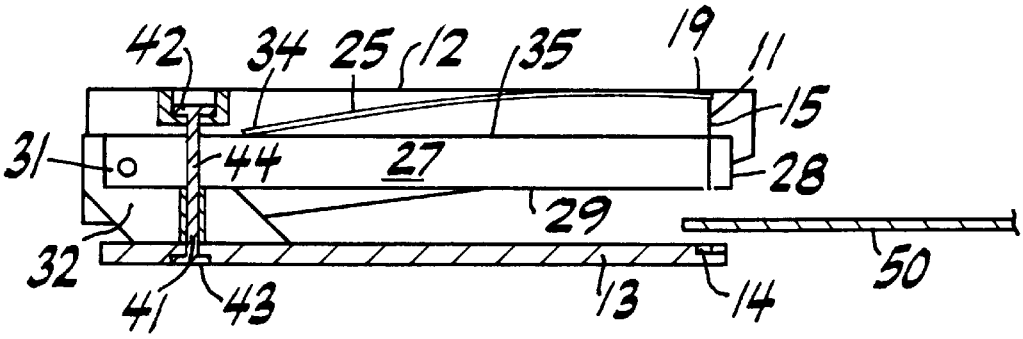
FIG. 5 is a cross-sectional side view of the cutting apparatus illustrated in FIG. 1.
Figure 6:
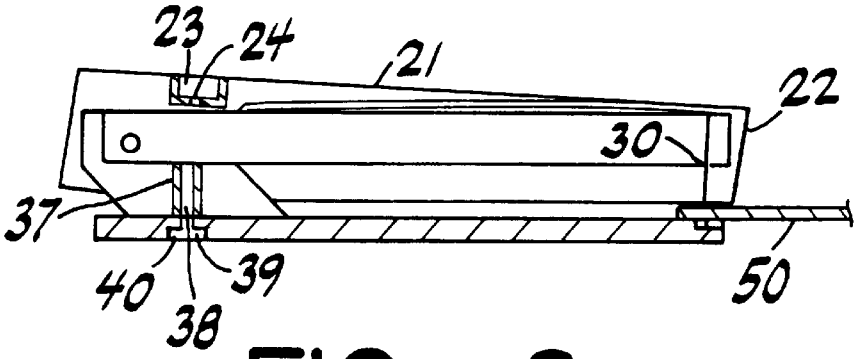
FIG. 6 is a cross-sectional side view of the cutting apparatus illustrated in FIG. 1 with the cutting assembly shown in its operative position but wherein the locking means has been removed.

The free end 34 of the leaf spring 25 rests upon or abuts against the upper edges 35 of the side walls 27 of the guide member 26 as illustrated in FIGS. 5 and 6.

The base wall 29, of the guide member 26, is maintained in a spaced relationship relative to the planar base 36, of the article support member 13, by an upstanding tubular abutment 37 located therebetween- The abutment 37 is mounted on the base 36 such that the bore 38 is aligned with a similar bore 39 formed in said base and which communicates with a cylindrically shaped recess 40 formed therein.

The free ends of the mounting member 12, the guide member 26 and the article support member 13 are prevented from being splayed apart by locking means comprising a resilient locking member 41 having a head portion 42 slideably located within the recess 23; a tail portion 43 fixed within the recess 40; and a stem 44 connecting the head portion 42 and the tail portion 43, said stem extending through bores 38 and 39 and an aligned aperture formed in the base wall 29 of the guide member 26.

Figure 3:
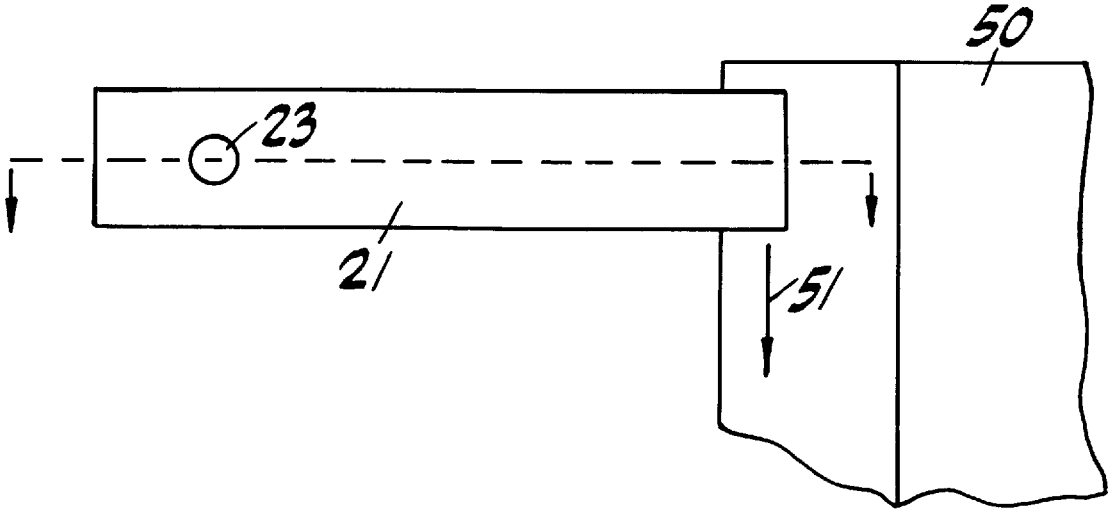
FIG. 3 is a plan view of the cutting apparatus illustrated in FIG. 1.
Figure 4:
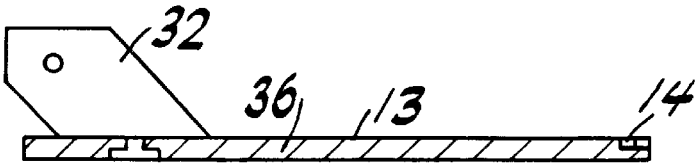
FIG. 4 is a cross-sectional side view of an article support member belonging to the cutting apparatus illustrated in FIG. 1.

In use, the cutting apparatus may be held in the palm of a user's hand and wherein an article 50 to be cut, such as the portion of an envelope adjacent an edge thereof, may be supported between the article supporting member 13 and the guide member 26 by the user's other hand in a fashion as generally illustrated by FIGS. 3, 5 and 6.

The user may by tightening his or her grip about the apparatus 10 overcome the resistance provided by the leaf spring 25 and thereby urge the free ends of the mounting member 12 and the article support member 13 together such that the incising end portion 16 extended through the slit 30 engages the complementary shaped recess 14 so as to form an incision in the article 50.

The user may, whilst maintaining sufficient pressure on the mounting member/actuating member 12, draw or slide the apparatus 10 relative to the material in a general direction indicated by arrow 51, for example, such that the cutting edge 18 cuts the portion of the material 50 which it bears against. It will however be appreciated that the cutting edges 1 may be slid in either straight lines or curves or intersecting lines or curves to cut the material as desired with a slicing action. Furthermore, the cutting edges 18 of the cutting blade 15 may be arranged at right angles to the intended direction of the slicing action, but may also be arranged at a non-perpendicular angle as appropriate.

It will also be appreciated that the portion of the guide member 26 surrounding the slit 30 provides support for the thin cutting blade during use, ie. prohibits undue relative movement of the cutting blade, should the blade encounter any resistance.

Once the pressure on the mounting member 12 is released, the action of the spring 25 returns the cutting assembly 11 to its former inoperative position shielded within the confines of the housing and the guide member 26, as shown in FIGS. 2 and 5.

It will be appreciated that during use the abutment 38 maintains a minimum spacing between the guide member 26 and the base 36 of the article supporting member 13.

Whilst not limiting the use of this invention to a particular use or application, it is believed that the cutting apparatus described herein may be suitable for use by disabled persons, children or persons having only one upper limb and that the configuration of the shielded cutting assembly 11 is unlikely to injure users of the apparatus.

It will of course be realised that while the above has been given by way of illustrative example of this invention, all such and other modifications and variations thereto as would be apparent to persons skilled in the art are deemed to fall within the broad scope and ambit of this invention as is defined in the appended claims.

I claim:

1. A cutting apparatus, comprising:

article support means for providing support for an article to be cut, said article support means having a receiving portion for receiving said article to be cut;

a handle having a first end portion, a second end portion and a longitudinal extent, said first end portion of said handle being pivotally connected to said article support means;

a cutting assembly comprising an incising end portion and a cutting portion extending therefrom, said cutting assembly being supported by said handle at said second end portion thereof and adapted to move with said second end portion of said handle to extend said incising end portion into said receiving portion to enable said article to be cut supported in said receiving portion to be punctured by said incising end portion by drawing said article to be cut through the cutting apparatus in a direction transverse to said longitudinal extent to said handle, wherein said cutting assembly is disposed in plane which is substantially parallel to an axis of rotation at said pivotal connection between said handle and said article support means;

guide means for guiding said cutting assembly, said guide means being disposed intermediate said handle and said article support means, and being adapted to shield said incising end portion and said cutting portion when said cutting assembly is disposed in an inoperative position;

biasing means for maintaining said cutting assembly in said inoperative position; and locking means for preventing said handle from being urged apart from said article support means a distance sufficient to enable a person to make contact with said cutting assembly.

2. The cutting apparatus of claim 1, wherein said guide means is adapted for supporting said cutting assembly.

* * * * *